US006260205B1

(12) United States Patent
Sansarlat

(10) Patent No.: US 6,260,205 B1
(45) Date of Patent: Jul. 17, 2001

(54) HYGIENIC PROTECTIVE DEVICE FOR A HEADGEAR CROWN

(76) Inventor: Jean-Jacques Sansarlat, 56, rue Hippolyte Bisson, 92500 Rueil-Malmaison (FR)

( * ) Notice: Subject to any disclaimer, the term of this patent is extended or adjusted under 35 U.S.C. 154(b) by 0 days.

(21) Appl. No.: 09/202,686

(22) PCT Filed: Jun. 20, 1997

(86) PCT No.: PCT/FR97/01110

§ 371 Date: Dec. 18, 1998

§ 102(e) Date: Dec. 18, 1998

(87) PCT Pub. No.: WO97/48299

PCT Pub. Date: Dec. 24, 1997

(30) Foreign Application Priority Data

Jun. 20, 1996 (FR) ..... 96 07683

(51) Int. Cl.[7] ..... A42C 1/00
(52) U.S. Cl. ..... 2/181; 2/63
(58) Field of Search ..... 2/63, 181, 182.1, 2/182.2, 182.8, 410, 411, 412, 414

(56) References Cited

U.S. PATENT DOCUMENTS

| | | | | |
|---|---|---|---|---|
| Re. 35,193 | * | 4/1996 | Shifrin | 2/410 |
| 1,852,930 | | 4/1932 | Hoppe . | |
| 2,136,678 | * | 11/1938 | Dym | 2/410 |
| 3,578,736 | | 5/1971 | Dootson . | |
| 3,613,114 | | 10/1971 | Hill et al. . | |
| 4,912,778 | | 4/1990 | Daniels . | |
| 5,058,210 | * | 10/1991 | Tivis | 2/181 |
| 5,515,546 | * | 5/1996 | Shifrin | 2/410 |
| 5,692,244 | * | 12/1997 | Johnson et al. | 2/181 |
| 5,996,126 | * | 12/1999 | Barthold et al. | 2/414 |

FOREIGN PATENT DOCUMENTS

| | | |
|---|---|---|
| 295 09 385 U | 10/1995 | (DE) . |
| 0 613 625 | 9/1994 | (EP) . |
| 2 485 342 | 12/1981 | (FR) . |
| 2 682 569 | 4/1993 | (FR) . |
| 02080608 | 9/1988 | (JP) . |
| 02289102 | 11/1990 | (JP) . |

* cited by examiner

*Primary Examiner*—Bibhu Mohanty
(74) *Attorney, Agent, or Firm*—Young & Thompson

(57) ABSTRACT

A protective device for headgear, in particular for a helmet, comprises at least one sheet made of an absorbent material. It is characterized in that the back of the absorbent sheet is integral with at least one semirigid and/or elastic deformable retaining element to be in contact with the headgear crown surface, and the deformation thereof shapes and maintains the absorbent sheet on that surface.

12 Claims, 1 Drawing Sheet

HYGIENIC PROTECTIVE DEVICE FOR A HEADGEAR CROWN

CROSS REFERENCE TO RELATED APPLICATION

This is the national phase of International application PCT/FR97/01110 filed on Jun. 20, 1997, which designated the United States of America.

The present invention relates to a device for ensuring hygienic protection of the crown of a headgear, particularly of a motor-cyclist's helmet.

BACKGROUND OF THE INVENTION

It is known to be particularly difficult for the users of helmets to maintain the crown thereof suitably and to protect them against different natural aggressions such as in particular perspiration or sebum, or against outside aggressions such as dust, which are translated by an obvious lack of hygiene and of comfort for the user.

OBJECT OF THE INVENTION

The present invention has for its object to propose a protective device allowing the user to have available headgear maintained under satisfactory conditions of comfort and of hygiene.

SUMMARY OF THE INVENTION

The present invention thus relates to a protective device for headgear, particularly for helmet, of the type comprising at least one sheet made of an absorbent material, characterized in that the back of the absorbent sheet is integral with at least one semi-rigid and/or elastic deformable retaining element to be in contact with the headgear crown surface, and the deformation thereof shapes and maintains the absorbent sheet on that surface.

In one embodiment of the invention, the back of the absorbent sheet, which may be constituted by a microperforated sheet, comprises at least one adhesive zone.

In another variant embodiment of the invention, the semi-rigid and/or elastic deformable element is constituted by a plurality of sectors possibly joined together by a central part. The sectors will preferably be sufficiently spaced apart to avoid their touching one another when the protective device is in place. Each side of the sectors may be formed by a first portion of radial rectilinear segment and by a second portion of rectilinear segment which extends inwardly of the sector with respect to the first segment.

The semi-rigid and/or elastic deformable element is preferably constituteed by four adjacent sectors with an angle at the center of 90°, so as to allow the protective device to be folded into four.

BRIEF DESCRIPTION OF THE DRAWINGS

Various forms of embodiment of the present invention will be described hereinafter by way of non-limiting examples, with reference to the accompanying drawings, in which.

DESCRIPTION OF THE PREFERRED EMBODIMENTS

Figure 1:
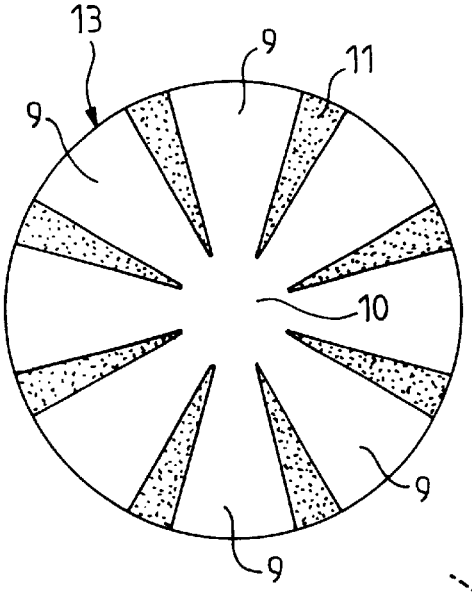
FIG. 1 is a plan view of an embodiment of a protective device according to the invention.

FIG. 1 shows the back face of a protective device 1 according to the invention. It is constituted by a disc 2 made in a sheet of absorbent material, such as in particular cellulose wadding, which is fixed on a retaining element 13 constituted by a thin sheet made of a deformable and semi-rigid material, for example cardboard. Deformable and semi-rigid material will preferably be understood to mean a material adapted not only to be deformed under the effect of a stress but adapted thereafter to conserve the shape conferred thereto, while conserving, nonetheless, characteristics of elasticity. In order to constitute the retaining element 13, cardboard may thus be used which, after deformation, maintains in part the shape which was given thereto, while nonetheless remaining a little elastic, which allows the protective device to be retained. This sheet 13 comprises a series of sectors 9 separated by cut-out zones 11, these sectors 9 being joined together by their central part 10. Connection of the retaining element 13 with the disc 2 made of absorbent material is ensured in particular by adhesion.

Figure 2:
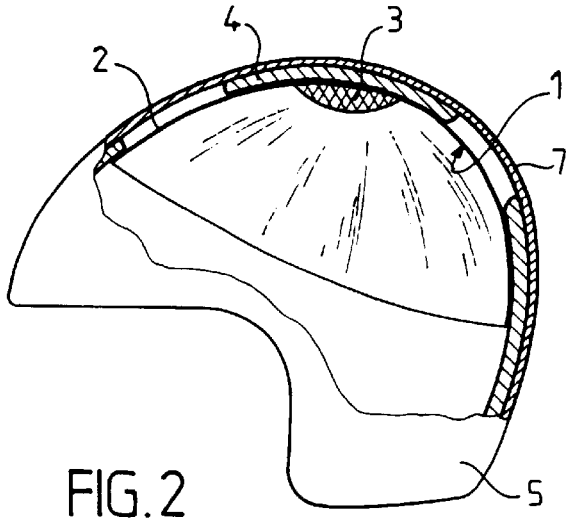
FIG. 2 is a view in elevation with partial section of a helmet equipped with a protective device according to the invention.

As shown in FIG. 2, a motor-cyclist's helmet 5 conventionally comprises a padding disc 4 fixed on the inner face of the wall 7 of the helmet 5. To place the protective device inside the latter, the sectors 9 are applied against the inner wall of the helmet 5, which thus conforms the protective device to the shape of the inner surface thereof By reason of its mechanical characteristics mentioned above, the retaining element 13 tends to apply the protective device against the inner walls of the helmet 5, which thus ensures that it is maintained inside said helmet.

The present device has the particularity of being adapted to any type of helmet, equally well to those whose crown comprises a padding, such a motor-cyclists' helmets, firemen's helmets whose crowns comprise nets, or military helments which comprise straps. Furthermore, adaptation is instantaneous.

Moreover, the low cost price of the protective device according to the invention guarantees marketing thereof as disposable product.

It is, of course, possible to retain the protective device inside the wall 7 of the helmet 5 with the aid of any other retaining means.

Figure 3:
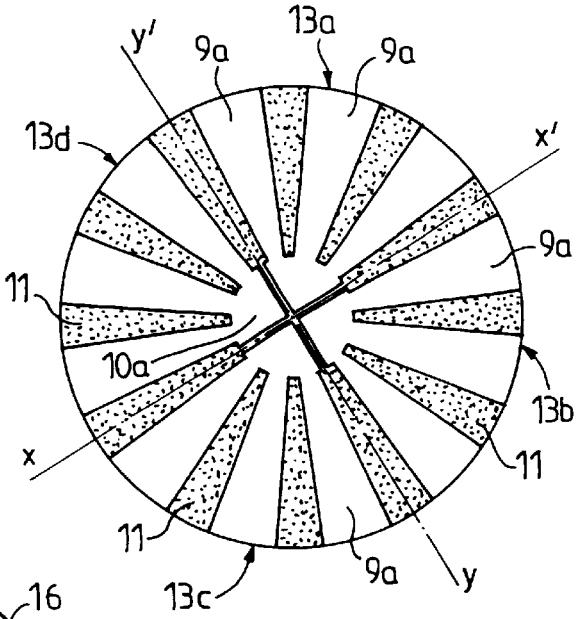
FIG. 3 is a plan view of a variant of the embodiment shown in FIG. 1.

It is, of course, possible for the retaining and shaping sheet not to be made in one piece as in the embodiment shown in FIG. 1. For example, FIG. 3 shows a protective device of which the retaining and shaping sheet is constituted by four elements 13*a*, 13*b*, 13*c* and 13*d* each formed by three sectors 9*a* connected together by their central part 10*a*. In this embodiment of the invention, folding of the protective device is promoted by the presence of the semi-rigid or elastic elements which constitute a guide for folding of the absorbent parts, making it possible to fold the protective device about the orthogonal lines xx' and yy' marking the limits of each of the elements 13*a*, 13*b*, 13*c* and 13*d*, which makes it possible to reduce its space requirement.

Furthermore, this form of embodiment allows an easy and rapid adaptation of the device to the crown of the headgear and an immediate shaping to the user's skull.

It is possible to produce the absorbent element and the retaining element in one piece. The retaining element may for example thus be constituted by an excess thickness of the absorbent element 2, which presents the advantage of easier manufacture. The retaining element may also be constituted by different embossed zones made from the absorbent sheet.

Figure 4:
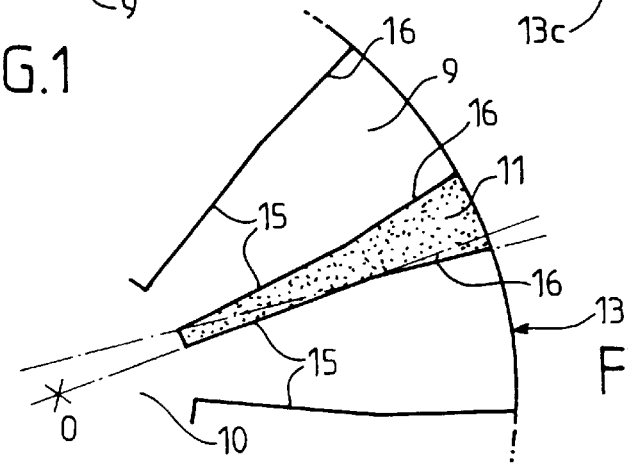
FIG. 4 is a partial, enlarged plan view of a variant embodiment of the invention.

As shown in FIG. 4, it is possible that each side of the sectors 9 or 9*a* is not constituted by a rectilinear segment, but by two parts of segment, namely a first part of segment 15 which is radial and a second part of segment 16 which extends inwardly with respect to the first. It has been observed that such an arrangement allowed a better shaping of the protective device.

The absorbent part of the disc 2 may advantageously be treated with antibacterial products, which makes it possible to improve the hygiene qualities contributed thereby, or with perfume products and/or reagents, particularly coloured ones making it possible to detect the user's sebum or perspiration.

A protective device may also be constituted according to the invention, comprising an elastic deformable layer disposed between two absorbent elements.

Fixation of the elastic deformable layer and of the absorbent element may be completed by adhesives, but also by any mechanical process. The elastic deformable elements may have undergone a micro-punching so as to give a porosity to the elastic deformable layer, which promotes breathing of the scalp.

What is claimed is:

1. Protective device for headgear having an inner crown surface, comprising at least one absorbent sheet made of a material adapted to absorb a user's perspiration and sebum, the absorbent sheet having a back which is integral with at least one semi-rigid and elastic deformable retaining element, which in use, is placed in contact with the crown surface; said deformable retaining element comprising a plurality of sectors; and a cut-out zone separating each pair of adjacent sectors whereby deformation of the retaining element shapes and maintains the absorbent sheet on the crown surface of the headgear.

2. The device according to claim 1, wherein the back of the absorbent sheet, intended to be placed in contact with the crown surface of the headgear, comprises at least one adhesive zone.

3. The device according to claim 1, wherein the sectors are radially disposed sectors of a circle.

4. The device according to claim 1, wherein the sectors are joined together by a central part.

5. The device according to claim 4, wherein the deformable retaining element comprises four adjacent sectors with an angle at the center of 90°, thereby allowing the protective device to be folded into four.

6. The device according to claim 1, wherein each side of the sectors is formed by a first portion of radial rectilinear segment, and by a second portion of radial rectilinear segment which extends inwardly of the sector, with respect to the first portion of the segment.

7. The device according to claim 6, wherein the deformable retaining element comprises four adjacent sectors with an angle at the center of 90°, thereby allowing the protective device to be folded into four.

8. The device according to claim 1, wherein the absorbent sheet contains at least one of an antibacterial product, a perfume, and a reagent for detecting one of sebum and perspiration.

9. The device according to claim 1, wherein the retaining element and the absorbent element are made in a single piece.

10. The device according to claim 9, wherein the retaining element is constituted by an excess thickness of the absorbent sheet.

11. The device according to claim 1, wherein the material comprises a microperforated sheet.

12. The device according to claim 1, wherein the absorbent material comprises cellulose wadding, and the retaining element comprises cardboard.

* * * * *